US007371129B2

(12) United States Patent
Mongold

(10) Patent No.: US 7,371,129 B2
(45) Date of Patent: May 13, 2008

(54) ELEVATED HEIGHT ELECTRICAL CONNECTOR

(75) Inventor: John A. Mongold, Middletown, PA (US)

(73) Assignee: Samtec, Inc., New Albany, IN (US)

( * ) Notice: Subject to any disclaimer, the term of this patent is extended or adjusted under 35 U.S.C. 154(b) by 85 days.

(21) Appl. No.: 11/115,591

(22) Filed: Apr. 27, 2005

(65) Prior Publication Data

US 2006/0246785 A1 Nov. 2, 2006

(51) Int. Cl.
*H01R 13/502* (2006.01)

(52) U.S. Cl. ..... 439/701; 439/74; 439/83; 439/140

(58) Field of Classification Search ..... 439/74, 439/83, 701, 65, 608
See application file for complete search history.

(56) References Cited

U.S. PATENT DOCUMENTS 3,376,543 A * 4/1968 Hammell ..... 439/540.1
4,230,387 A * 10/1980 Zahn ..... 439/590
4,804,341 A * 2/1989 Kato et al. ..... 439/733.1
5,137,462 A * 8/1992 Casey et al. ..... 439/74
5,181,855 A * 1/1993 Mosquera et al. ..... 439/74
5,269,692 A * 12/1993 Takahashi ..... 439/74
5,382,168 A * 1/1995 Azuma et al. ..... 439/65
5,421,746 A * 6/1995 David ..... 439/701
5,836,773 A * 11/1998 McHugh et al. ..... 439/74
6,095,826 A * 8/2000 Potters ..... 439/79
6,129,592 A * 10/2000 Mickievicz et al. ..... 439/701
6,409,525 B1 * 6/2002 Hoelscher et al. ..... 439/140
6,503,108 B1 * 1/2003 Kikuchi et al. ..... 439/680
6,511,353 B2 * 1/2003 Champion et al. ..... 439/891
6,733,305 B2 * 5/2004 Pan et al. ..... 439/74
6,743,053 B2 * 6/2004 Wu ..... 439/634
6,749,445 B1 * 6/2004 Chen ..... 439/79
6,821,135 B1 * 11/2004 Martin ..... 439/144
6,863,542 B2 * 3/2005 Miyashita ..... 439/74
6,869,292 B2 * 3/2005 Johnescu et al. ..... 439/74
6,875,027 B2 * 4/2005 Ye et al. ..... 439/74
6,893,285 B1 * 5/2005 Chiang ..... 439/378
7,056,134 B2 * 6/2006 Martin et al. ..... 439/169
7,094,109 B2 * 8/2006 Chou ..... 439/651
7,186,123 B2 * 3/2007 Lemke et al. ..... 439/83

* cited by examiner

*Primary Examiner*—Briggitte Hammond
*Assistant Examiner*—Larisa Tsukerman
(74) *Attorney, Agent, or Firm*—Keating & Bennett, LLP

(57) ABSTRACT

An electrical connector includes first and second connector bodies which are arranged to first be positioned together, and then separated once electrical contacts have been inserted in at least one of the first and second connector bodies. During, after, or both during and after the separating of the two connector bodies, portions of the first and second connector bodies are in direct contact with each other. The first connector body has first and second walls extending therefrom. At least one ramp and at least one stop are arranged on at least one of the first wall, the second wall, and the second connector body. At least one protrusion is arranged on at least one of the first wall, the second wall, and the second connector body. The at least one ramp, the at least one stop, and the at least one protrusion are arranged such that, when the at least one ramp and the at least one stop engage the at least one protrusion, a distance between the first and second connector bodies is fixed.

23 Claims, 9 Drawing Sheets

ELEVATED HEIGHT ELECTRICAL CONNECTOR

BACKGROUND OF THE INVENTION

1. Field of the Invention

The present invention relates to electrical connectors. More specifically, the present invention relates to elevated height electrical connectors.

2. Description of the Related Art

As an electrical connector becomes taller, signal integrity performance of the electrical connector decreases. Thus, elevated height electrical connectors have lower performance compared to lower height electrical connectors. Further, elevated height electrical connectors typically require several extra manufacturing steps not required for lower height electrical connector. These extra manufacturing steps add additional material and labor cost.

In known elevated height electrical connectors, electrical contacts are supported on each end by one of a first and a second connector body. Extra support mechanisms are typically disposed between the first and second connector bodies, which require secondary manufacturing steps to secure the extra support mechanisms to the first and second connector bodies.

Typically, a plastic body is disposed between the first and second connector bodies and is arranged to support and position the medial portion of the electrical contacts. The plastic body adds additional plastic surrounding the medial portions of the electrical contacts.

A typical known elevated height electrical connector is assembled using the following steps:

1) electrical contacts are inserted into the first connector body to support and position one end of the electrical contacts;

2) the plastic body is provided to support and position the medial portion of the electrical contacts; and 3) the second connector body is provided to support and position the other end of the electrical contacts to finish the assembly of the known elevated height electrical connector.

In step 2) above, the plastic body is typically glued, welded, press fit, or heat staked to the first connector body. Further, in step 3), the second connector body is also glued, welded, press fit, or heat staked to the plastic body.

A typical known elevated height electrical connector can also be assembled using the following steps:

1) a plastic body is provided in contact with the first connector body;

2) electrical contacts are inserted into the first connector body and the plastic body to support and position one end and the medial portion of the electrical contacts; and 3) the second connector body is provided to support and position the other end of the electrical contacts to finish the assembly of the known elevated height electrical connector.

In step 1) above, the plastic body is typically glued, welded, press fit, or heat staked to the first connector body. Further, in step 3), the second connector body is also glued, welded, press fit, or heat staked to the plastic body.

When a plastic body is not used, it is also known to use a means of supporting and locating the electrical contacts during the assembling of the electrical connector. The electrical contacts are inserted into the first connector body in order to support and locate one end of the electrical contacts. The means of locating and supporting the electrical contacts is then used during the step of locating and securing the second connector body to the other end of the electrical contacts. Then, after the first and second connector bodies locate and secure the ends of the electrical contacts, the means of locating and supporting the pins is removed.

In another method that does not use a plastic body, the first and second connector bodies are placed in contact with each other. The electrical contacts are press fit into the cores of both the first and the second connector bodies in order to locate and support the electrical contacts. Then, the first and second connector bodies are separated to form the electrical connector having an elevated height. During and after the separation of the first and second connector bodies, the first and second connector bodies are not in contact with each other.

It is also known to press fit one end of the electrical contacts into the cores of the first connector body in order to locate and support the one end of the electrical contacts and to allow the medial portions of the electrical contacts to float in the cores of the second connector body. The first and second connector bodies are then separated. The other end of the electrical contacts is frictionally secured into the second connector body by barbs on the other end of the electrical contacts. As with the previous method, during and after the separation of the first and second connector bodies, the first and second connector bodies are not in contact with each other.

SUMMARY OF THE INVENTION

To overcome the problems described above, preferred embodiments of the present invention provide an electrical connector having an increased height that is easy to assemble and reliably and safely position contacts in the electrical connector.

According to a preferred embodiment of the present invention, an electrical connector includes a first connector body having first and second walls extending therefrom, a second connector body disposed between the first and second walls, at least one ramp and at least one stop are arranged on at least one of the first wall, the second wall, and the second connector body, and at least one protrusion arranged on at least one of the first wall, the second wall, and the second connector body, wherein the at least one ramp, the at least one stop, and the at least one protrusion are arranged such that, when the at least one ramp and the at least one stop engage the at least one protrusion, a distance between the first and second connector bodies is fixed.

The first connector body preferably includes a first plurality of cores and the second connector body preferably includes a second plurality of cores. The cores of the first and second connector bodies can be arranged in a regular array or in an irregular array. Also, each of the first and second connector bodies can include at least two arrays of cores which can be arranged differently from each other.

A plurality of pins or electrical contacts extends through both the first and second plurality of cores, and the pins preferably include a fusible mass on one end thereof. One or both ends of the plurality of pins are each secured to one of the first and second plurality of cores.

The at least one protrusion is preferably defined by at least one ledge extending from a side of the second connector body or at least one ledge extending from at least one of the first and second walls.

Also, it is preferred that the at least one of the first wall, the second wall, and the second connector body includes at least one rib, and that the at least one of the first wall, the second wall, and the second connector body includes at least one slot, such that the at least one rib and the at least one slot are arranged such that the at least one rib engages the at least one slot. The at least one rib is preferably located on one of the first and second walls, and the at least one rib preferably includes a lead-in.

When the at least one ramp, the at least one stop, and the at least one protrusion are engaged, the plurality of pins are separated only by air along the length of the plurality of pins between the first and second connector bodies.

The at least one stop and the at least one ramp are preferably located at or near the distal end of the at least one of the first and second walls. Also, when the at least one ramp, the at least one stop, and the at least one protrusion are engaged, the distance between the first and second walls is substantially constant, and when the at least one ramp, the at least one stop, and the at least one protrusion are not engaged, the distance between the first and second walls varies along the direction defined by the length of the first plurality of cores. Furthermore, the distance between the distal ends of the first and second walls is preferably smaller than the distance between the proximal ends of the first and second walls.

The at least one ramp preferably includes an inclined portion extending at an acute angle relative to said at least one of the first wall, the second wall, and the second connector body, and a ledge portion extending substantially perpendicular relative to said at least one of the first wall, the second wall, and the second connector body.

Also, at least one of the first and second connector bodies preferably includes a polarization key and the polarization key includes a protrusion that extends from the at least one of the first and second connector bodies.

In another preferred embodiment of the present invention, an electrical connector includes a first connector body having first and second walls extending therefrom, a second connector body disposed between the first and second walls, at least one rib arranged on at least one of the first wall, the second wall, and the second connector body, and at least one slot arranged on at least one of the first wall, the second wall, and the second connector body, wherein the at least one rib and the at least one rib are arranged to engage each other such that the distance between the first and second connector bodies can be varied.

The distance between the first and second connector bodies is preferably fixed by at least one of the following a) at least one ramp, at least one stop, and at least one protrusion, each of the at least one ramp, the at least one stop, and the at least one protrusion are arranged on at least one of the first wall, the second wall, and the second connector body, and b) the first wall, the second wall, and the connector body being glued together; c) the first wall, the second wall, and the connector body being welded together; d) the first wall, the second wall, and the connector body being press fit together; and e) the first wall, the second wall, and the connector body being heat staked together.

In another preferred embodiment of the present invention, an electrical apparatus includes a substrate having conductive elements on a surface thereof, and an electrical connector according to any of the preferred embodiments described above, wherein the electrical connector is mechanically and electrically attached to the substrate via the conductive elements thereof.

According to yet another preferred embodiment of the present invention, a method of manufacturing an electrical connector includes the steps of providing a first connector body having a first plurality of cores, providing a second connector body having a second plurality of cores, inserting a plurality of pins into the first plurality and the second plurality of cores, and separating the first and the second connector bodies, wherein during, after, or both during and after the step of separating, portions of the first and second connector bodies come into or are in direct contact with each other.

The first connector body preferably includes first and second walls arranged such that the second connector body and the first and second walls come into or are in direct contact during, after, or both during and after the step of separating.

Before the step of separating, the distance between the first and second walls varies along the direction defined by the length of the first plurality of cores, and the distance between distal ends of the first and second walls is less than the distance between proximal ends of the first and second walls.

After the step of separating, the distance between the first and second walls is substantially constant along the direction defined by the length of the first plurality of cores.

At least one of the first wall, the second wall, and the second connector body preferably includes at least one rib, and at least one of the first wall, the second wall, and the second connector body includes at least one slot, such that the at least one rib and the at least one slot are arranged such that during the step of separating, the at least one rib engages the at least one slot. The at least one rib is preferably located on one of the first and second walls, and the at least one rib preferably includes a lead-in.

At least one of the first wall, the second wall, and the second connector body preferably includes at least one stop, and the at least one stop is arranged to prevent any additional separation of the first and second connector bodies during the step of separation. The at least one stop is preferably located at or near the distal end of the at least one of the first and second walls.

At least one of the first wall, the second wall, and the second connector body includes at least one ramp, and the at least one ramp is arranged to prevent a contraction of the distance between the first and second connector bodies once a desired distance of separation between the first and second connector bodies has been achieved. Also, the at least one ramp preferably includes an inclined portion extending at an acute angle relative to the at least one of the first wall, the second wall, and the second connector body, and a ledge portion extending substantially perpendicular to said at least one of the first wall, the second wall, and the second connector body.

At least one of the first wall, the second wall, and the second connector body includes at least one ramp and at least one stop, and the at least one ramp and the at least one stop are arranged to fix the distance between the first and second connector bodies.

Before the step of separating, one end of each of the plurality of pins is secured in one of the first and the second plurality of cores. Each of the plurality of pins include a fusible mass.

At least one of the first and second connector bodies preferably includes a polarization key, and the polarization key includes a protrusion that extends from the at least one of the first and second connector bodies.

The plurality of pins are inserted into the first plurality of cores before the plurality of pins are inserted into the second plurality of cores.

The second connector body includes at least one beveled corner.

During and after the step of separating, the plurality of pins are separated only by air along the length of the plurality of pins between the first and second connector bodies.

During the step of separating, the plurality of pins float in one of the first and second pluralities of cores.

After the step of separating, one end of each of the plurality of pins is secured in one of the first and second plurality of cores.

According to another preferred embodiment of the present invention, a method of manufacturing an electrical connector includes the steps of providing a first connector body having a first plurality of cores, providing a second connector body having a second plurality of cores, inserting a plurality of pins into the first plurality and the second plurality of cores, separating the first and the second connector bodies, and fixing at least one wall to one of the first and second connector bodies in order to fix the distance between the first and second connector bodies.

Other features, elements, steps, characteristics and advantages of the present invention will become more apparent from the following detailed description of preferred embodiments of the present invention with reference to the attached drawings.

DETAILED DESCRIPTION OF PREFERRED EMBODIMENTS

Figure 1A:
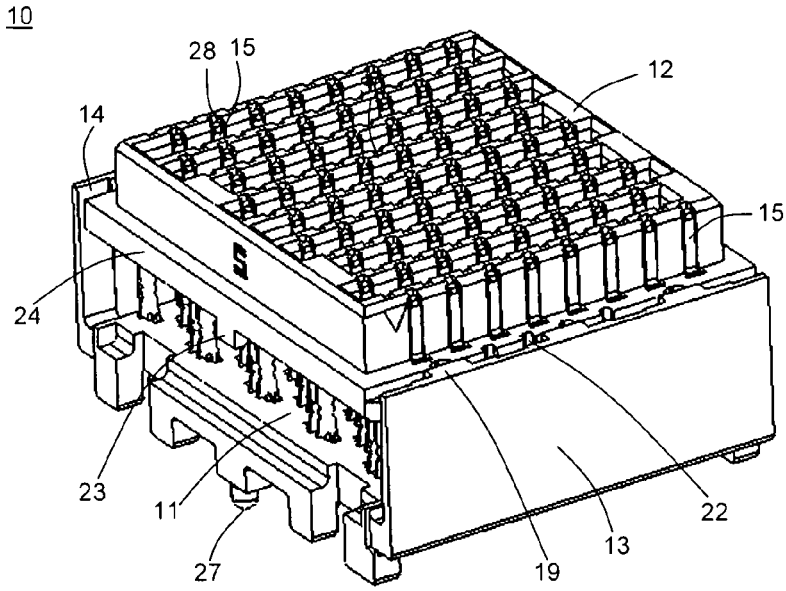
FIG. 1A is an isometric view of the electrical connector according to a preferred embodiment of the present invention.
Figure 1B:
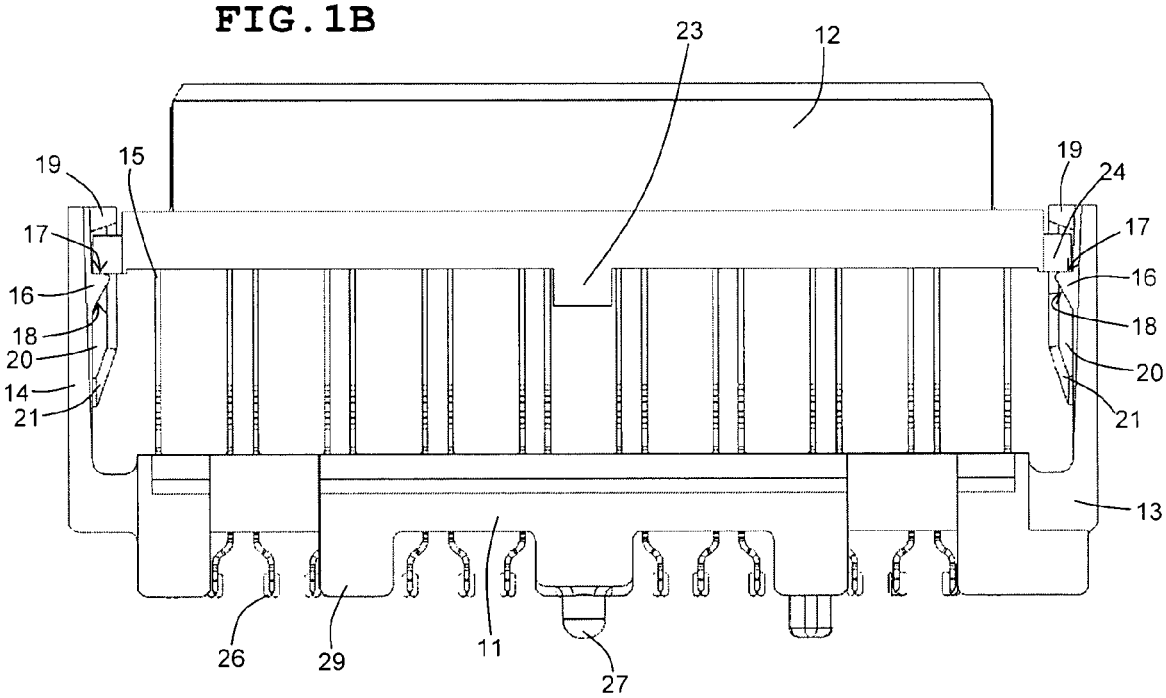
FIG. 1B is a side view of the electrical connector according to a preferred embodiment of the present invention.

FIGS. 1A and 1B illustrate an electrical connector 10 according to the preferred embodiment of the present invention. Electrical connector 10 includes a first connector body 11 and a second connector body 12. The first connector body 11 and the second connector body 12 locate and support a plurality of electrical contacts 15.

The cores 30 of the first connector body 11 and the second connector body 12 can be arranged in any suitable manner depending upon the type or types of electrical signals that will be transmitted through the electrical connector 10. FIGS. 5A-5F are schematic drawings illustrating various possible core arrangements. However, electrical connector 10 could have any core arrangement.

Figure 5A:
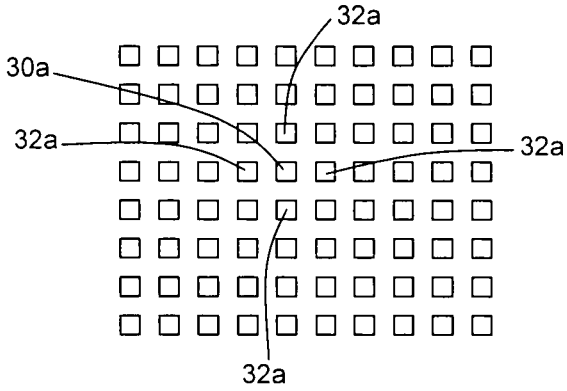
FIGS. 5A-F are schematic drawings of possible core arrangements in the electrical connector according to a preferred embodiment of the present invention.

FIG. 5A illustrates a core arrangement in which the cores 30 are arranged in a regular array. That is, each core 30*a* is spaced the same distance from the cores 32*a* nearest to it. The core arrangement shown in FIG. 5A could be used to transmit both single-ended and differential signals. If differential signals are transmitted through the electrical connector 10, then typically the electrical contacts 15 in the cores 30*a* surrounding the cores 30*a* passing the differential signals will be grounded.

Figure 5B:
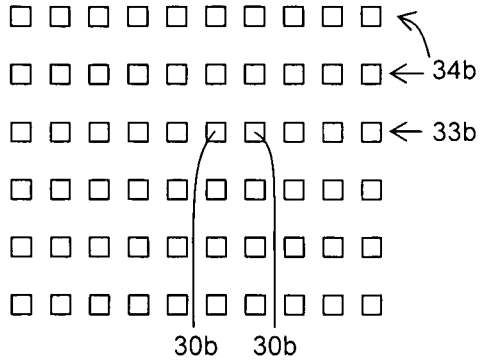

FIGS. 5B-5F illustrate core arrangements in which the cores 30 are arranged in an irregular array. An irregular array is an array which is not a regular array. FIG. 5B illustrates a core arrangement in which cores 30*b* in the same row 33*b* are equally spaced along a horizontal direction and in which adjacent rows 34*b* along a vertical direction have a different spacing than the cores 30*b* in the same row 33*b*. An electrical connector 10 having this arrangement could pass both single-ended and differential signals. If differential signals are transmitted, then typically the electrical contacts 15 in the core 30*b* in the same row 33*b* and between the cores 30*b* passing different differential signals will be grounded.

Figure 5C:
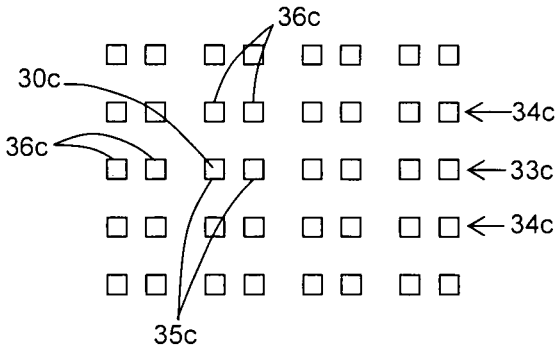

FIG. 5C illustrates a core arrangement in which the cores 30*c* of the same row 33*c* have different spacing and in which the rows 33*c*, 34*c* are evenly spaced. That is, the cores 30*c* in the same row 33*c* are grouped into pairs 35*c* such that cores 30*c* in the same pair 35*c* are spaced closer to each other in the horizontal direction than the adjacent core of an adjacent pair 36*c* in both the same row 33*c* and in different rows 34*c*. That is, the distance between the two cores of the pair 35*c* or 36*c* is less than the distance between adjacent pairs 35*c* and 36*c*. In an electrical connector 10 with this core arrangement, differential signals can be transmitted without using grounding electrical contacts 15 in some of the cores 30*c*. Single-ended signals can also be transmitted through an electrical connector 10 having this core arrangement.

Figure 5D:
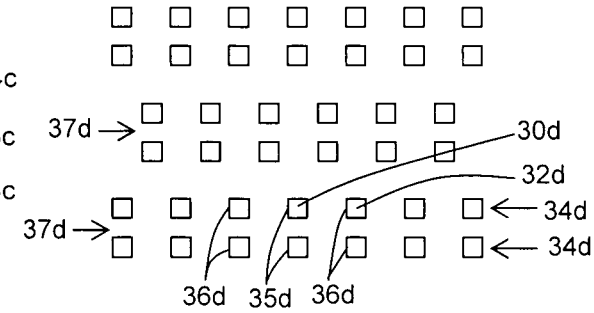

FIG. 5D illustrates a core arrangement in which cores 30*d* of adjacent rows 34*d* in the vertical direction are paired such that the cores 30*d* in the same vertical pair 35*d* are closer to each other than adjacent cores 32*d* in adjacent, different pairs 36*d* in the same row of paired cores 37*d*. That is, the distance between the two cores 30*d* of the pair 35*d* is less than the distance between the pair 35*d* and the pair 36*d*. Further, adjacent rows of paired cores 37*d* are offset from each other along the length of rows of paired cores 37*d*. With this core arrangement, adjacent differential signals will have a reduced cross-talk compared to the arrangement in FIG.

5C if similar spacing between adjacent differential signals is used. Single-ended signals can also be transmitted through an electrical connector 10 having this core arrangement.

Figure 5E:
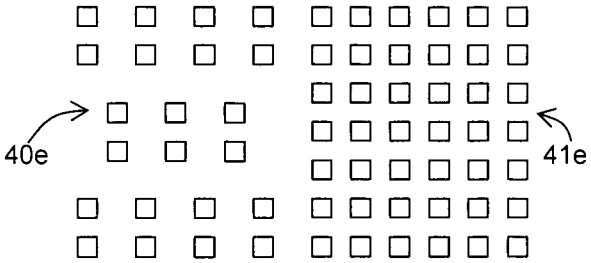
Figure 5F:
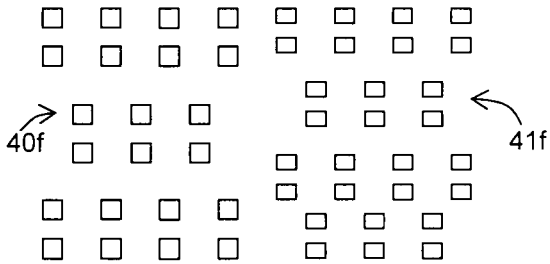

FIGS. 5E and 5F illustrate core arrangements in which the cores 30*e* and 30*f*, respectively, are arranged in two different arrays. FIG. 5E illustrates a core arrangement in which the two arrays 40*e* and 41*e* are arranged differently. That is, the first array 40*e* is similar to the array shown in FIG. 5D, and the second array 41*e* is similar to the array shown FIG. 5A. FIG. 5F illustrates a core arrangement in which the arrays are similar. That is, the first array 40*f* and the second array 41*f* are similar to the array shown in FIG. 5D, but the first array 40*f* and the second array 41*f* have different spacing between the cores.

FIGS. 5A-5F illustrate core arrangements preferably having a square cross-sectional shape. However, any other suitable cross-sectional shape, including rectangular, for example, could be used.

The first connector body 11 and the second connector body 12 are fixed a certain distance apart by the engagement of the ledge portion 17 of the ramp 16 located on the first wall 13 and the second wall 14 with the bottom surface of the base 24 located on the second connector body 12 and by the engagement of the stop 19 located on the first wall 13 and the second wall 14 with the top surface of the base 24, i.e., the portions of the base 24 facing the ramps 16 and stops 19 of the first 13 and second 14 walls act as a protrusion that fits between the ramp 16 and the stop 19. Thus, the height of the electrical connector 10 is determined by the height of the first wall 13 and the second wall 14 and by the length of the electrical contacts 15. That is, by selecting the height of the first wall 13 and the second wall 14 and the length of the electrical contacts 15, the height of the electrical connector 10 can be selected.

FIGS. 1A and 1B show that the first wall 13 and second wall 14 preferably extend along sides of the first connector body 11. However, the first wall 13 and the second wall 14 may also extend along the ends of the first connector body 11.

Figure 2A:
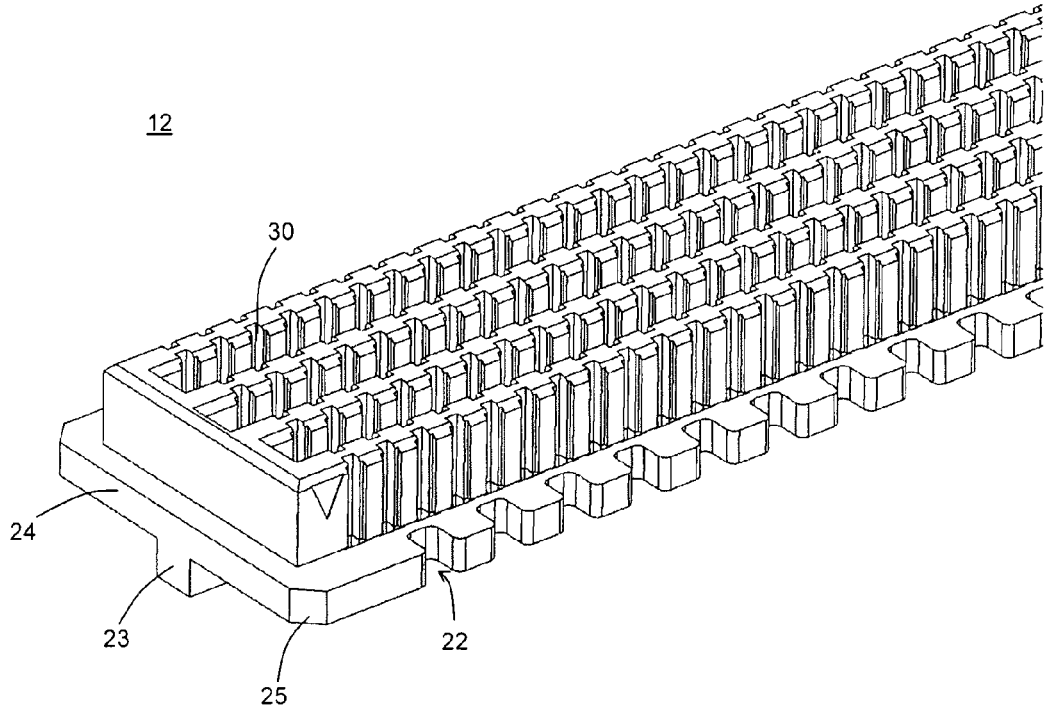
FIG. 2A is a partial isometric view of the second connector body of the electrical connector according to the preferred embodiment of the present invention shown in FIGS. 1A and 1B.
Figure 2B:
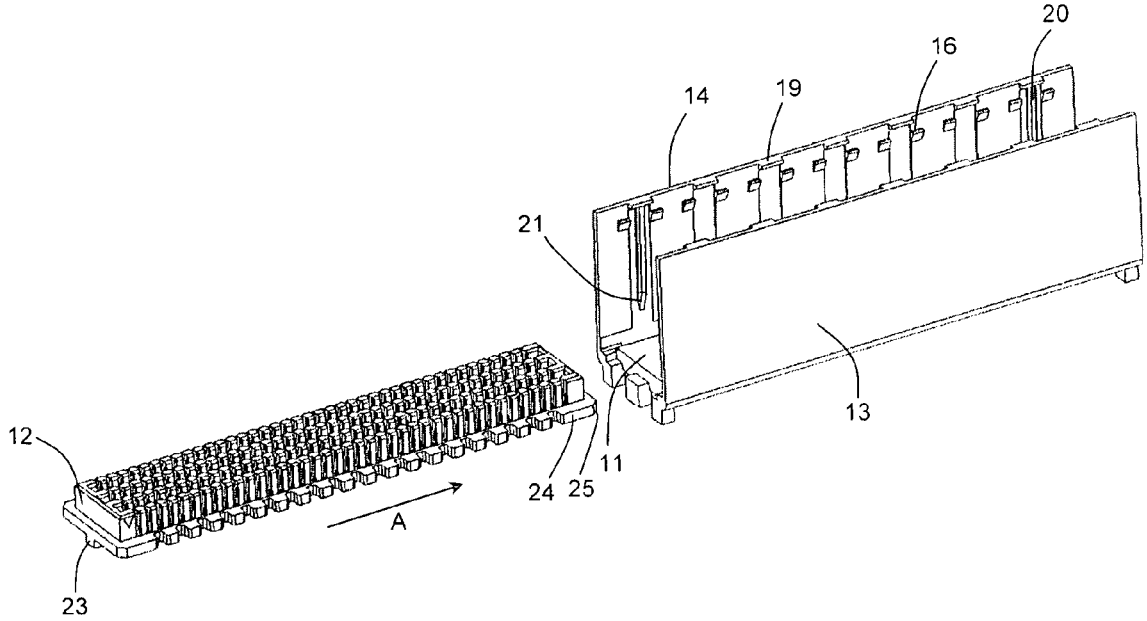
FIG. 2B is a view illustrating a method step of manufacturing the electrical connector according to the preferred embodiment of the present invention shown in FIGS. 1A and 1B.

As shown in FIGS. 1A and 2B, each of the first wall 13 and the second wall 14 can include a plurality of ramps 16 and stops 19. However, only one ramp 16 and one stop 19 could be used to fix the distance between the first connector body 11 and the second connector body 12. Further, although FIG. 1B shows that the ramps 16, including the ledge portion 17 and the ramp portion 18, and stops 19 are located on the first wall 13 and on the second wall 14 and that the base 24 is located in the second connector body 12, this arrangement could be reversed. That is, the ramps, including the ledge portion and the ramp portion, and the stops could be located on the second connector body 12, and a base could extend from the first wall 13 and the second wall 14 to engage the ramps and the stops located on the first wall 13 and the second wall 14.

The alignment of the first connector body 11 and the second connector body 12 with respect to each other is fixed by the engagement of ribs 20 located on the first wall 13 and second wall 14 with slots 22 located in the second connector body 12 and by the engagement of the outer surface of the base 24 located on the second connector body 12 with the first wall 13 and the second wall 14. Further, although FIG. 1B shows that the ribs 20, including a lead-in 21, are located on the first wall 13 and the second wall 14 and that the slots 22 are located in the second connector body 12, this arrangement could be reversed. That is, the slots could be located in the first wall 13 and the second wall 14, and ribs could extend from the second connector body 12 to engage the slots located in the first wall 13 and the second wall 14.

Each electrical contact 15 preferably includes a fusible material, for example, solder 26, on one end of the contact 15, and includes a contact head 28 on the other end. The solder 26 on the electrical contact 15 is used to form a mechanical and electrical connection to a substrate (not shown). Typically, the electrical connector 10 would be reflowed/soldered to a printed circuit board (not shown). However, the electrical connector could be attached to any other suitable substrate. FIG. 1B shows that the fusible material 26 is preferably crimped solder. However, other arrangements for the fusible material 26 could also be used, for example, solder balls or solder charges. Further, instead of including solder 26 on the electrical contact 15, any other fusible material could be used to form the mechanical and electrical connection. Instead of having the solder 26 on the electrical contact 15, the fusible material or solder could be provided on any substrate to which the electrical contact 15 is to be soldered.

Figure 7A:
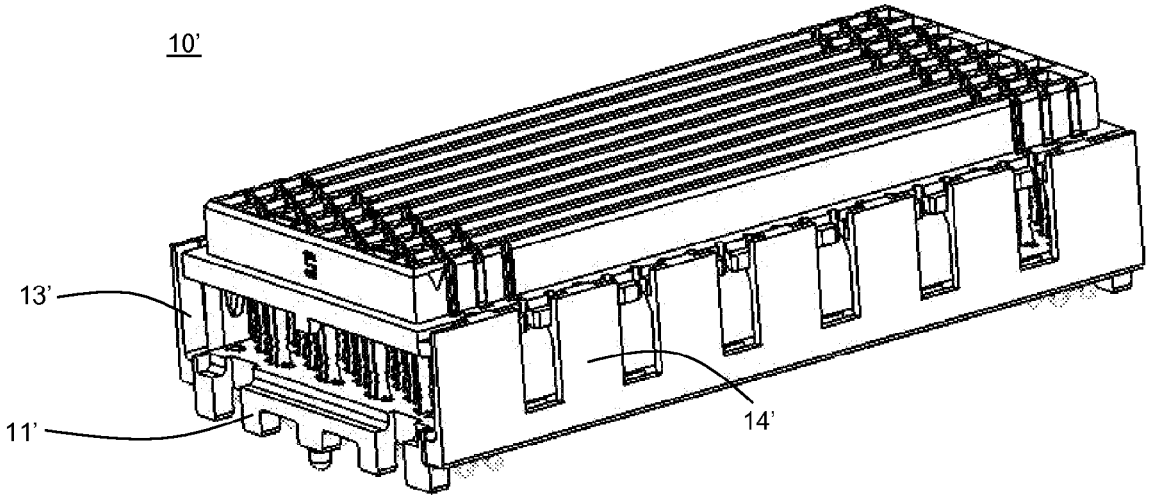
FIG. 7A is a perspective view of an electrical connector according to a preferred embodiment of the present invention.
Figure 7B:
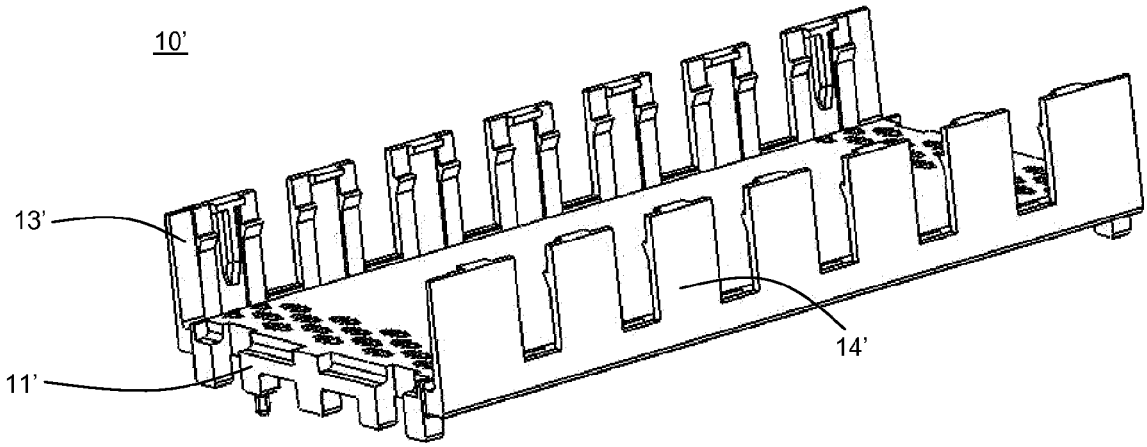
FIG. 7B is a perspective view of a portion of an electrical connector according to a preferred embodiment of the present invention.

As seen in FIG. 1A, each of the first wall 13 and the second wall 14 preferably extend continuously from one end of the first connector body 11 to the other end of the first connector body 11. However, the first wall 13 and the second wall 14 do not need to extend continuously from one end of the first connector body 11 to the other end of the first connector body 11. That is, an electrical connector 10' can include a plurality of first wall portions 13' that extend from one side of the first connector body 11' and can include a second plurality of second wall portions 14' that extend from the other side of the first connector body 11', as shown in FIGS. 7A and 7B.

Figure 6:
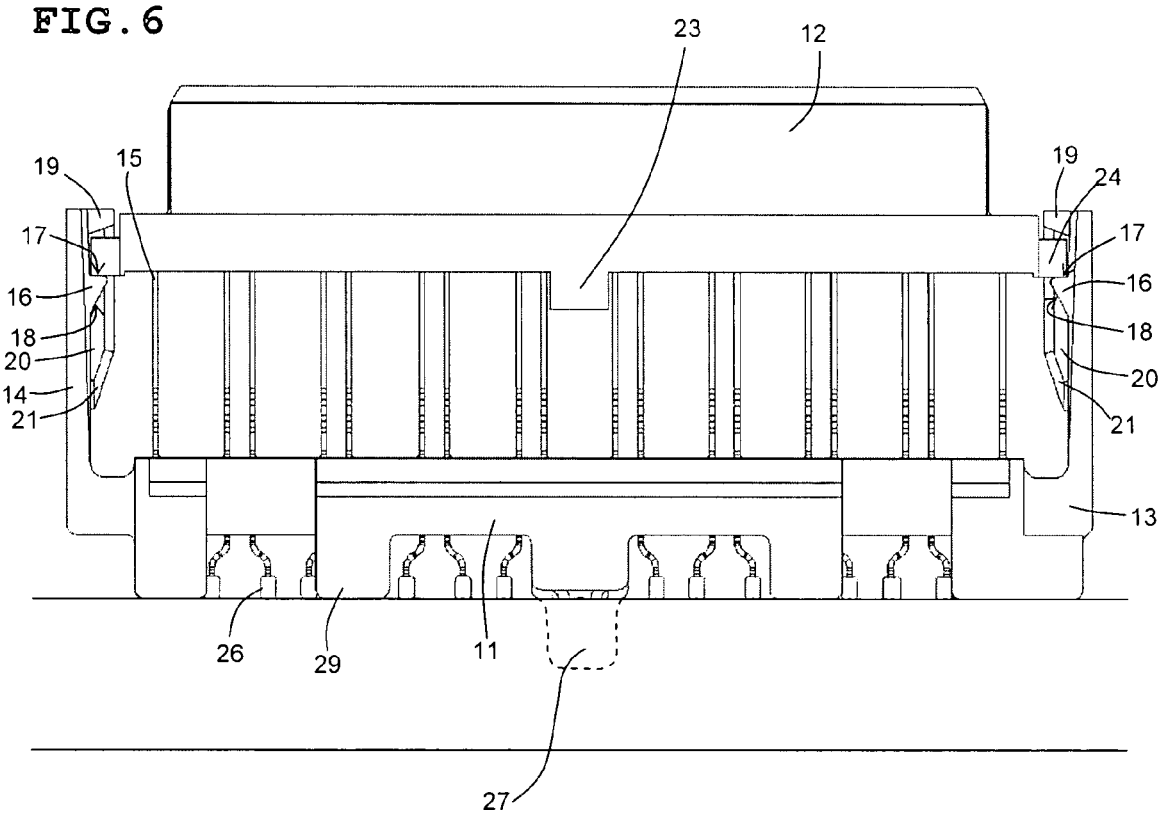
FIG. 6 is a schematic drawing of a connector system including a substrate and an electrical connector according to a preferred embodiment of the present invention attached thereto.

As seen in FIG. 1B, the first connector body 11 preferably includes an alignment pin 27. Alignment pin 27 is used to guide the electrical connector 10 to the proper location on the substrate at which the electrical connector 10 is to be attached. After the electrical connector 10 is located on the substrate and during the soldering process, standoffs 29, shown in FIGS. 1A and 1B, are used to fix the distance between the bottom of the electrical contacts 15 and the substrate 100 to which the electrical connector 10 is to be soldered, as shown in FIG. 6.

As seen in FIGS. 1A and 1B, the electrical contacts 15 are only separated by air along the length of the electrical contacts 15 extending between the first connector body 11 and the second connector body 12. That is, air is the dielectric material separating the electrical contacts where the electrical contacts 15 extend between the first connector body 11 and the second connector body 12.

FIGS. 2A-4 illustrate a method of manufacturing the electrical connector 10. FIG. 2A illustrates a portion of the second connector body 12 before the second connector body 12 is inserted into the first connector body 11, as shown in FIG. 2B. The second connector body 12 includes a plurality of slots 22 formed in the base 24 that extends around the outer periphery of the second connector body 12. The second connector body 12 also includes a polarization key 23 (discussed below) that extends from base 24. The base 24 of the second connector body 12 preferably includes beveled corners 25.

FIG. 2B shows the manufacturing step of inserting the second connector body 12 along direction A into the first connector body 11. Beveled corners 25 on the base 24 of the second connector body 12 allows for easier insertion of the second connector body 12 into the first connector body 11. As shown in FIG. 2B, the second connector body 12 is inserted between the first wall 13 and the second wall 14 of the first connector body 11, spaced from the ramps 16 and the stops 19 on the first wall 13 and the second wall 14 and below the lead-ins 21 of the ribs 20 on the first wall 13 and the second wall 14.

Figure 3A:
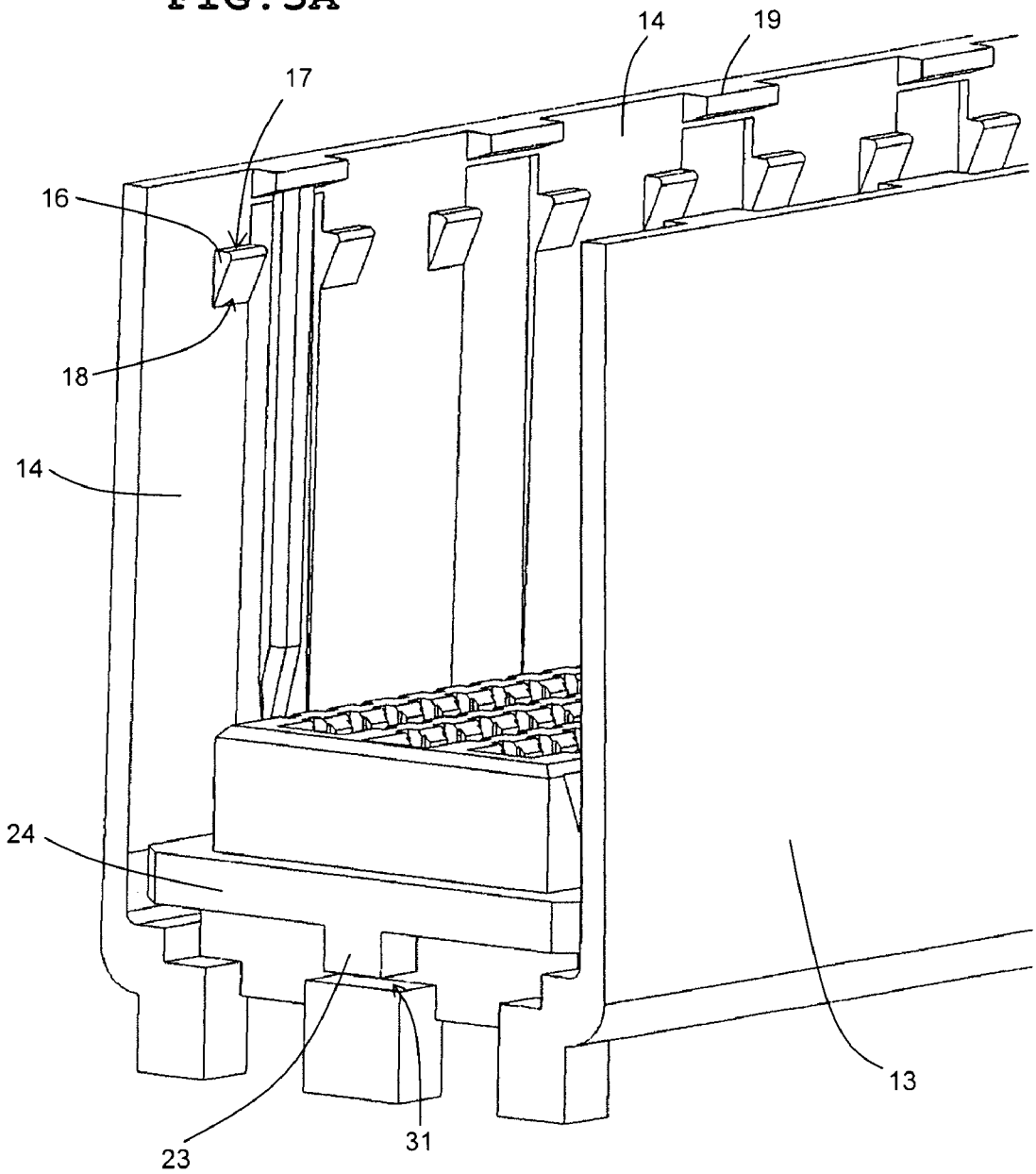
FIG. 3A is a partial isometric view illustrating one end the electrical connector during the manufacturing of the electrical connector according to a preferred embodiment of the present invention.
Figure 3B:
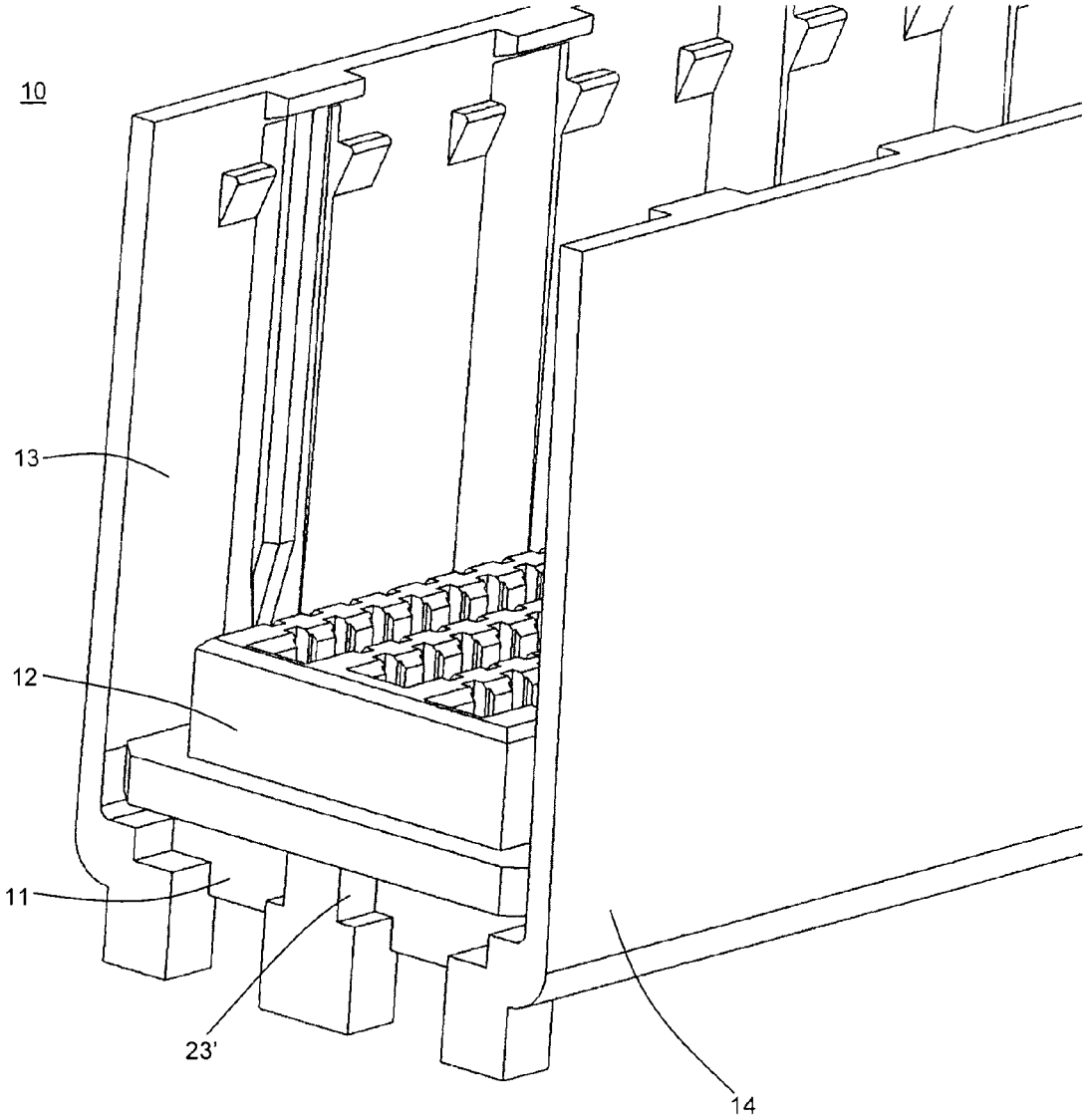
FIG. 3B is a partial isometric view illustrating the other end the electrical connector during the manufacturing of the electrical connector according to a preferred embodiment of the present invention.

As shown in FIG. 3A, the second connector body 12 includes a polarization key 23, and as shown in FIG. 3B, the first connector body includes a polarization key 23'. The polarization keys 23 and 23' are arranged such that, when the second connector body 11 is inserted in between the first wall 13 and the second wall 14, the second connector body 12 can only have one correct orientation with respect to the first connector body 12. If the second connector body 12 is inserted into the first connector body 11 with an orientation other than the correct orientation, then polarization keys 23 and 23' will be located on the same side of the electrical connector 10 and will prevent the second connector body 12 from making flush contact with the first connector body 11. That is, if the polarization keys 23 and 23' are not properly aligned, the second connector body 12 cannot be properly inserted into the first connector body 11.

As shown in FIG. 3A, the polarization key 23 extending from the base 24 of the second connector body 12 contacts the base 31 of the first connector body 11 when the second connector body 12 is inserted into the first connector body 11 with the proper orientation. As shown in FIG. 3B, the polarization key 23' of the first connector body 11 contacts the base 24 of the second connector body 12 when the second connector body 12 is inserted into the first connector body 11 with the proper orientation.

Instead of using polarization keys 23 and 23' shown in FIGS. 3A and 3B, any other suitable polarization key or alignment mechanism could be used.

As shown in FIGS. 3A and 3B, the ramps 16 and stops 19 are preferably located near the distal ends of the first wall 13 and the second wall 14. Ramps 16 include in a ledge portion 17 that extends substantially perpendicular from the first wall 13 and the second wall 14 and that engages the bottom surface of the base 24 of the second connector body 12 once the base 24 has been moved into its final position (described later). The ramps 16 also include an inclined portion 18 that extends at an angle from the first wall 13 and the second wall 14.

Figure 3C:
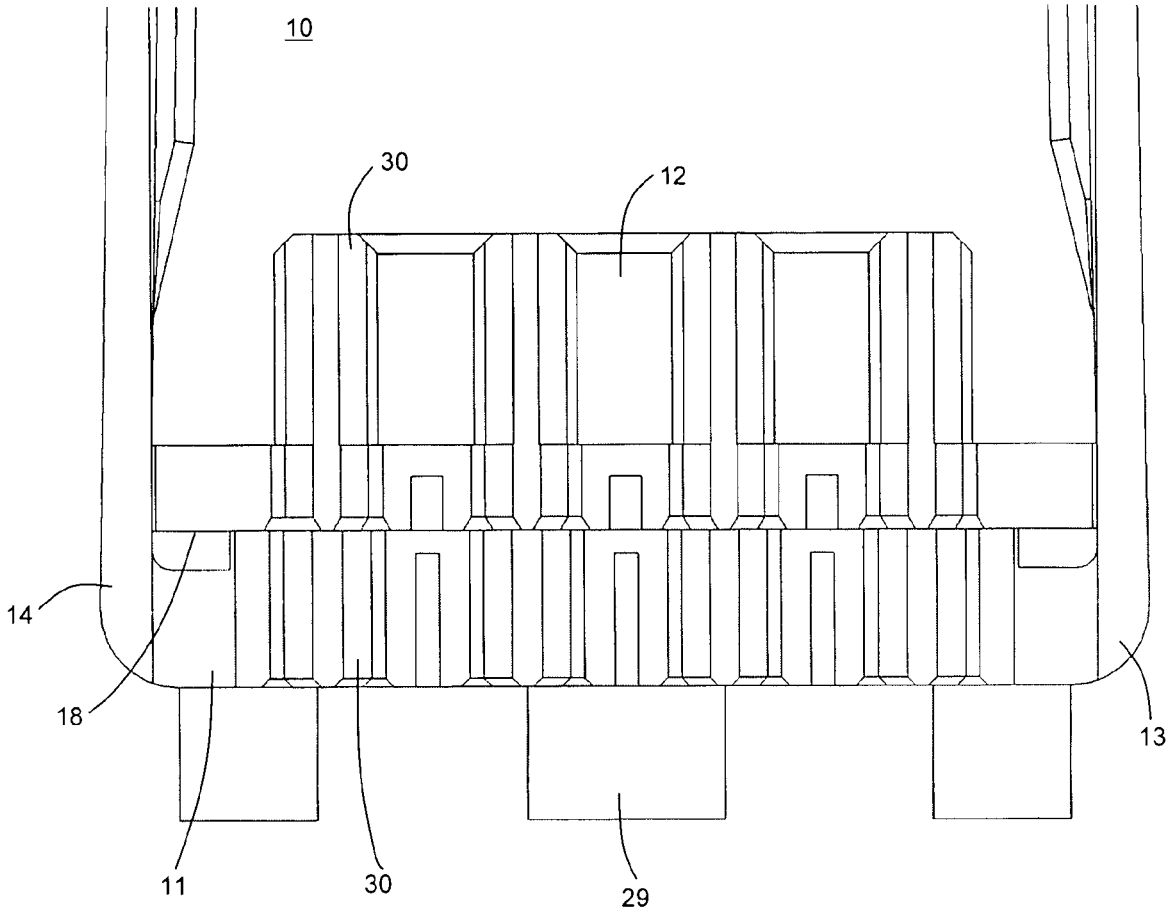
FIG. 3C is a sectional view of the electrical connector during the manufacturing of the electrical connector according to a preferred embodiment of the present invention.

As shown in FIG. 3C, the cores 30 of the first connector body 11 and the second connector body 12 align with each other when the second connector body 12 is inserted into the first connector body 11 with the proper orientation. The first wall 13 and the second wall 14 are substantially parallel to the direction defined by the length of the cores 30 of the first connector body 11.

Figure 4:
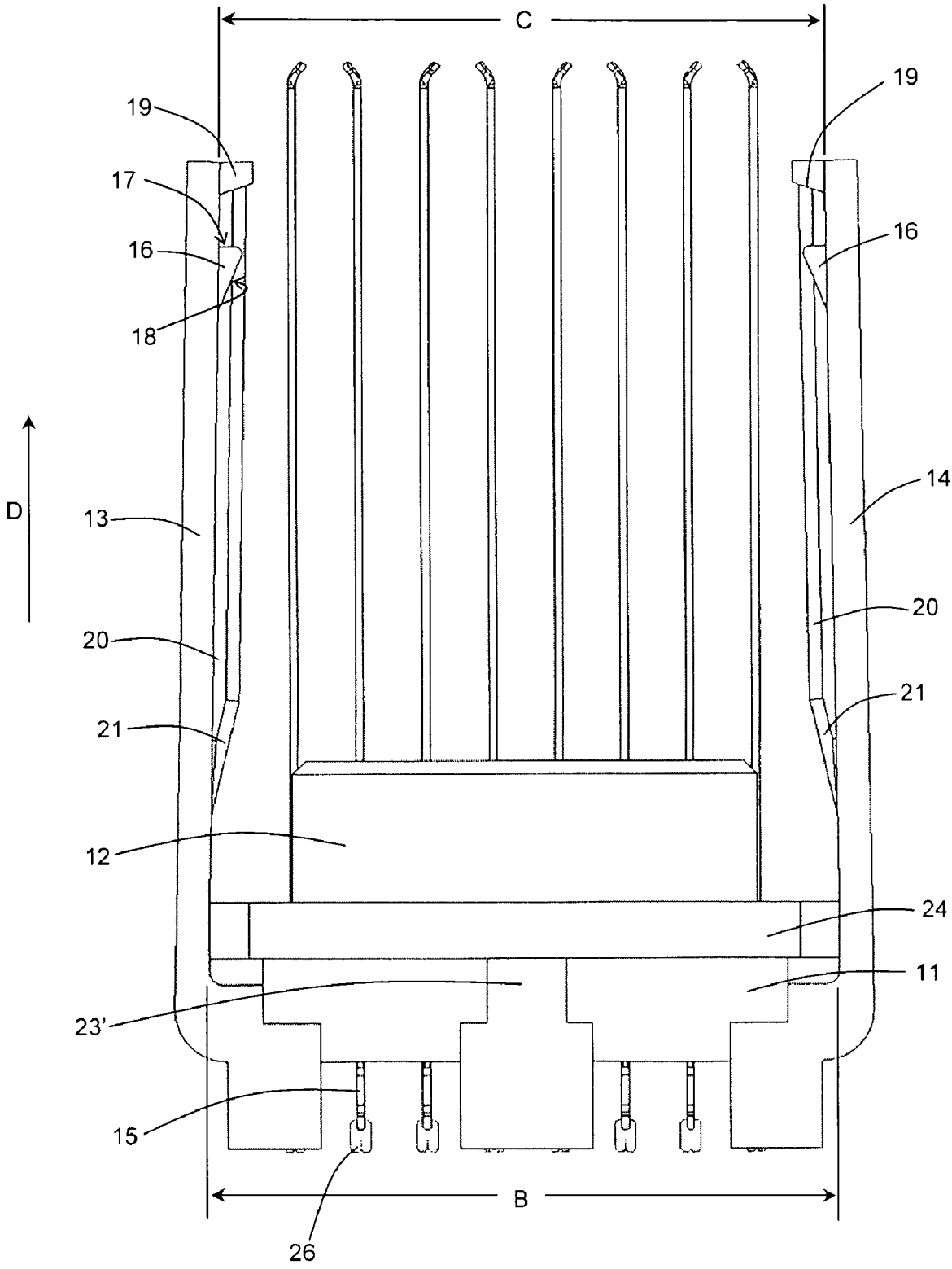
FIG. 4 is a side view illustrating a method step of manufacturing of the electrical connector according to a preferred embodiment of the present invention.

As shown in FIG. 4, the electrical contacts 15 are inserted into the cores 30 (not shown in FIG. 4) of the first connector body 11 and the second connector body 12 with an orientation such that the end of the electrical contacts 15 including solder 26 extend from the first connector body 11 and the end of the electrical contacts 15 without the solder 26 extend from the second connector body 12.

The electrical contacts 15 are preferably pressed into cores 30 of the first connector body 11. Alternatively, the electrical contacts 15 could be pressed into the second connector body 12. Instead of pressing the electrical contacts 15 into the cores 30 of the first connector body 11 or the second connector body 12, any other suitable method of securing the electrical contacts 15 to the first connector body 11 can be used. Methods other than press fitting can be used to secure the contacts 11 in the connector body 11 or 12, such as using an interference fit, retention barbs, or contacts already molded into a connector body.

The electrical contacts 15 can be first inserted into either the cores 30 of the first connector body 11 or the cores 30 of the second connector body 12.

As seen in FIG. 4, the distance B between the proximal ends of the first wall 13 and the second wall 14 is greater than the distance C between the distal ends of the first wall 13 and the second wall 14. That is, the first wall 13 and the second wall 14 are inwardly inclined toward each other.

After all of the electrical contacts 15 have been inserted into the cores 30 of the first connector body 11 and the second connector body 12, the first connector body 11 and the second connector body 12 are pulled apart along direction D.

The first and second connector bodies can be pulled apart by 1) anchoring the first connector body 11 and pulling the second connector body 12 away from the first connector body 11; 2) anchoring the second connector body 11 and pulling the first connector body 12 away from the second connector body 11; and 3) pulling the first connector body 11 and the second connector body away from each other.

As the first connector body 11 and the second connector body 12 are pulled apart, the lead-ins 21 of the ribs 20 engage the slots 22 (not shown in FIG. 4) in the base 24. As the first connector body 11 and the second connector body 12 are pulled further apart, the ribs 20 engage slots 22 in order to maintain the alignment of the first connector body 11 and the second connector body 12.

Also, as the first connector body 11 and the second connector body 12 are pulled apart, the second connector body 12, the first wall 13, and the second wall 14 are maintained in contact with each other because the first wall 13 and the second wall 14 are inclined inwardly toward each other.

Alternatively, the distance between the proximal ends of the first wall 13 and the second wall 14 can be approximately equal to the distance the distance between the distal ends of the first wall 13 and the second wall 14. Also, the distance between the proximal ends of the first wall 13 and the second wall 14 can be smaller than the distance between the distal ends of the first wall 13 and the second wall 14, or vice versa.

As the first connector body 11 and the second connector body 12 are pulled even further apart, the inclined portion 18 of the ramp 16 engages the base 24 of the second connector body 12. Once the base 24 of the second connector body moves past the ramp 16, the first wall 13 and the second wall 14 snap back such that the first wall 13 and the second wall 14 contact the outer peripheral edge of the base 24 of the second connector body 12. After the first wall 13 and the second wall 14 snap back, the ledge portions 17 of the ramps 16 and the stops 19 fix the distance between the first connector body 11 and the second connector body 12. That is, the ledge portions 17 of the ramps 16 prevent the contraction of the distance between the first connector body 11 and the second connector body 12, and the stops 19 prevent any additional separation of the first connector body 11 and the second connector body 12.

The electrical contacts 15 can float in the cores 30 of the second connector body 12 during after the separation of the first connector body 11 and the second connector body 12. Alternatively, the electrical contacts 15 can be secured to the cores 30 of second connector body 12 after the separation of the first connector body 11 and the second connector body 12 by any suitable means after the first connector body 11 and the second connector body 12 are separated, including being pressed into the cores 30 of the second connector body 12.

Instead of securing the electrical contacts 15 in the cores 30 of the first connector body 11 and allowing the electrical contacts 15 to float in the cores 30 of the second connector body 12 during the separation of the first connector body 11 and the second connector body 12 as discussed above, the electrical contacts 15 can be secured to the cores 30 of the second connector body 12 and allowed to float in the cores 30 of the first connector body 11 during the separation of the first connector body 11 and the second connector body 12.

Once the inclined portion 18 of the ramps 16 and the stops 19 engage the base 24 of the second connector body 12, the electrical connector 10 is completed as shown in FIGS. 1A and 1B.

In addition to using the ramps 16, the stops 19, and the base 24, the first wall 13 and the second wall 14 could be attached to the second connector body 12 by gluing, welding, press fitting, heat staking, or any other suitable method.

Alternatively, instead of providing the first connector body 11 with the first wall 13 and the second wall 14, the first wall 13 and the second wall 14 can be attached to the first connector body 11 and the second connector body 12 after the electrical contacts 15 have been inserted into cores 30 of the first connector body 11 and the second connector body 12, and after the first connector body 11 and the second connector body 12 have been pulled apart to a certain distance. That is, the first wall 13 and the second wall 14 are provided to fix the distance between the first connector body 11 and the second connector body 12 after the first connector body 11 and the second connector body 12 have been pulled apart. The first wall 13 and the second wall 14 can be attached to the first connector body 11 and the second connector body 12 by any suitable means.

It should be noted that the first connector body 11 and the second connector body 12 described above may also be referred to as a socket or header which form a mated connector, which is to be attached to a substrate as shown in FIG. 6.

It should be understood that the foregoing description of various preferred embodiments is only illustrative of the present invention. Various alternatives and modifications can be devised by those skilled in the art without departing from the present invention. Accordingly, the present invention is intended to embrace all such alternatives, modifications and variances which fall within the scope of the appended claims.

What is claimed is:

1. An electrical connector comprising:

a first connector body having first and second walls extending therefrom;

a second connector body disposed between the first and second walls;

a plurality of pins;

at least one ramp and at least one stop arranged on at least one of the first wall, the second wall, and the second connector body; and at least one protrusion arranged on at least one of the first wall, the second wall, and the second connector body; wherein the at least one ramp, the at least one stop, and the at least one protrusion are arranged such that, when the at least one ramp and the at least one stop engage the at least one protrusion, a distance between the first and second connector bodies is fixed; and a portion of each pin of the electrical connector that extends between a core of the first connector body and a core of the second connector body extends in a substantially straight line such that, after each pin of the electrical connector has been inserted into the core of the first connector body and into the core of the second connector body, the first connector body and the second connector body are free to move to and from a position where the first connector body and the second connector body are in direct contact with each other.

2. An electrical connector according to claim 1, wherein the first and second walls extend in a direction defined by the length of the cores of the first connector body.

3. An electrical connector according to claim 1, wherein the plurality of pins extend through both the cores of both the first and second connector bodies.

4. An electrical connector according to claim 1, wherein the plurality of pins include a fusible mass on one end thereof.

5. An electrical connector according to claim 1, wherein the at least one protrusion is defined by at least one ledge extending from a side of the second connector body.

6. An electrical connector according to claim 1, wherein the at least one protrusion is defined by at least one ledge extending from at least one of the first and second walls.

7. An electrical connector according to claim 1, wherein the at least one stop and the at least one ramp are located at or near the distal end of the at least one of the first and second walls.

8. An electrical connector according to claim 1, wherein, when the at least one ramp, the at least one stop, and the at least one protrusion are engaged, the distance between the first and second walls is substantially constant.

9. An electrical connector according to claim 1, wherein one or both ends of the plurality of pins are each secured to one of the cores of the first connector body and the cores of the second connector body.

10. An electrical connector according to claim 1, wherein the at least one ramp includes an inclined portion extending at an acute angle relative to said at least one of the first wall, the second wall, and the second connector body, and a ledge portion extending substantially perpendicular relative to said at least one of the first wall, the second wall, and the second connector body.

11. An electrical connector according to claim 1, wherein the second connector body includes at least one beveled corner.

12. An electrical connector according to claim 1, wherein, when the at least one ramp, the at least one stop, and the at least one protrusion are engaged, the plurality of pins are separated only by air along the length of the plurality of pins between the first and second connector bodies.

13. An electrical connector according to claim 1, wherein at least one of the first and second walls includes a plurality of wall portions.

14. An electrical connector according to claim 1, wherein the cores in each of the first and second connector bodies are arranged in a regular array.

15. An electrical connector according to claim 1, wherein the cores in each of the first and second connector bodies are arranged in an irregular array.

16. An electrical connector according to claim 1, wherein the cores in each of the first and second connector bodies are arranged into first and second array of cores; and the first array of cores is different than the second array of cores.

17. An electrical apparatus comprising:

a substrate having conductive elements on a surface thereof; and an electrical connector according to claim 1; wherein the electrical connector is mechanically and electrically attached to the substrate via the conductive elements thereof.

18. An electrical connector according to claim 1, wherein at least one of the first wall, the second wall, and the second connector body includes at least one rib;

at least one of the first wall, the second wall, and the second connector body includes at least one slot; and the at least one rib and the at least one slot are arranged such that the at least one rib engages the at least one slot.

19. An electrical connector according to claim 18, wherein the at least one rib is located on one of the first and second walls.

20. An electrical connector according to claim 1, wherein, when the at least one ramp, the at least one stop, and the at least one protrusion are not engaged, the distance between the first and second walls varies along the direction defined by the length of the first plurality of cores.

21. An electrical connector according to claim 20, wherein the distance between the distal ends of the first and second walls is smaller than the distance between the proximal ends of the first and second walls.

22. An electrical connector according to claim 1, wherein at least one of the first and second connector bodies includes a polarization key.

23. An electrical connector according to claim 22, wherein the polarization key includes a protrusion that extends from the at least one of the first and second connector bodies.

* * * * *